United States Patent [19]

Meyerhoefer et al.

[11] 4,408,622

[45] Oct. 11, 1983

[54] FINGERNAIL EXTENSION

[75] Inventors: Carl H. Meyerhoefer, Huntington Station; Carl E. Meyerhoefer, Little Neck, both of N.Y.

[73] Assignee: Revlon, Inc., New York, N.Y.

[21] Appl. No.: 258,123

[22] Filed: Apr. 27, 1981

[51] Int. Cl.[3] ..... A45D 29/00
[52] U.S. Cl. ..... 132/73
[58] Field of Search ..... 132/73

[56] References Cited

U.S. PATENT DOCUMENTS

| | | | |
|---|---|---|---|
| 1,238,046 | 8/1917 | Nuss | 132/73 |
| 4,135,526 | 1/1979 | Matranga | 132/73 |

FOREIGN PATENT DOCUMENTS

| | | | |
|---|---|---|---|
| 662080 | 11/1951 | United Kingdom | 132/73 |
| 579980 | 11/1977 | U.S.S.R. | 132/73 |

*Primary Examiner*—Gregory E. McNeill

[57] ABSTRACT

An artificial fingernail extension having formed a wedge shaped pocket at the rearward end, the convex edge of the natural fingernail is inserted into said pocket and securely bonded thereto.

3 Claims, 5 Drawing Figures

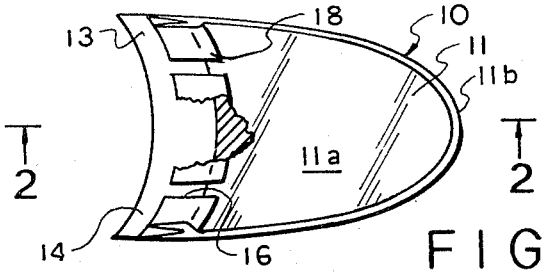
FIG. 1
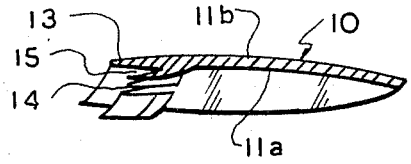
FIG. 2
FIG. 3
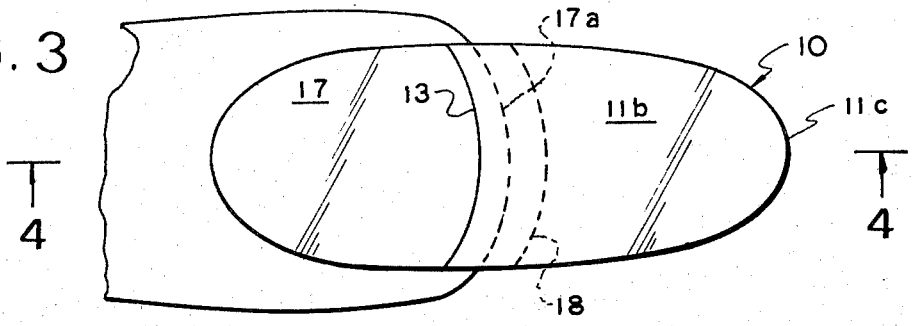
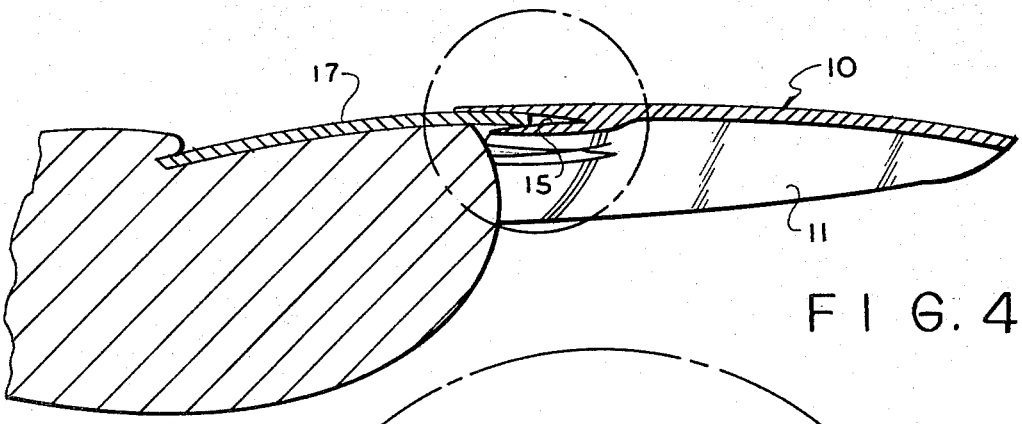
FIG. 4
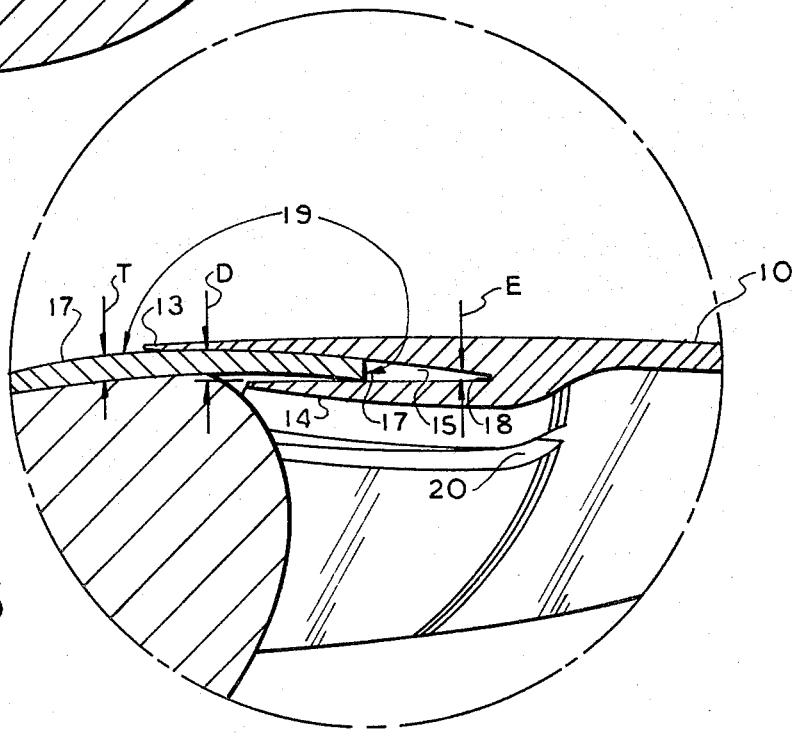
FIG. 5

FINGERNAIL EXTENSION

BACKGROUND OF THE INVENTION (1) Field of the Invention

This invention relates to artificial fingernail extensions. More particularly, the invention relates to an artificial fingernail extension having improved means for attaching the fingernail extension to the natural fingernail.

(2) The Prior Art

The use of artificial fingernails and fingernail extensions are a commonly used cosmetic beauty aid despite the present difficulties.

It has been a practice to adhesively attach artificial fingernails directly to cover the upper exposed surfaces of fingernails. This type of nail risks damage to the live portion of the natural nails and also requires considerable time and effort since small personal variations in the natural nails preclude exact design conformance.

Efforts to provide suitable fingernail extensions covering only a portion of the nail are shown in U.S. Pat. No. 4,135,526, wherein an artificial fingernail is described which, while providing a suitable bonding resistance against displacement by downward force, provides inadequate resistance against upward force. In U.S. Pat. No. 4,007,748 there is shown a structure which provides attachment to the end edge of the natural nail at a very small bonding area and its usefulness depends entirely on the strength of the adhesive used for bonding.

In addition, the successful application of artificial nail tips made according to the teachings of the above patents, requires the use of two hands and a goodly amount of skill. They are, therefore, not very suitable for self application by a lay person.

SUMMARY OF THE INVENTION

It is therefore the general object of this invention to provide an artificial fingernail extension for attachment to the tip of a natural nail. Another object of this invention is to provide an artificial fingernail extension having improved strength in both the upward and downward directions through improved attachment and adhesion to the natural nail.

It has been found that the objects of this invention are accomplished by an artificial nail having rearward concave edges forming a pocket into which the natural nail fits. The artificial nail is bonded to the tip of the natural nail using a quick-drying, liquid adhesive. The positioning of the artificial fingernail extension onto the tip of the natural nail is achieved in an accurate and quick manner.

BRIEF DESCRIPTION OF THE DRAWINGS

The nature of the invention described herein may be best understood and appreciated by the following description taken in connection with the accompanying drawings in which:

FIG. 1 is a bottom view of the fingernail extension of this invention;

FIG. 2 is a side view of the fingernail extension of this invention taken along lines 2—2 of FIG. 1;

FIG. 3 is a top plan view showing application of the artificial nail to a natural fingernail;

FIG. 4 is a section view taken along lines 4—4 of FIG. 3; and

FIG. 5 is an enlarged view of the circled section of FIG. 4.

DETAILED DESCRIPTION OF THE INVENTION

Referring now to the drawings, there is shown the artificial fingernail extension 10 of this invention having body 11 which is longitudinally elongated and transversely upwardly convex. The opposite sides of nail body 11 taper forwardly as shown in FIGS. 1 and 3 and the body may be rounded at its forwardmost edge 11*c*. Preferably, but not necessarily, the body convex upper surface 11*b* tapers toward the body concave lower surface 11*a*, whereby the forward edge 11*c* is typically sharp. Also, the body lateral edges are usually as sharp as the natural nail.

The nail body 11 has a generally concave rearward peripheral distal upper edge 13 and a rearward flexible lower edge 14 forming wedge shaped arcuate pocket 15 ending in a concave line 18 as shown in FIGS. 3 and 5. Upper edge 13 is tapered to a feather edge and slightly longer than flexible lower edge 14 to fit over and attach to natural nail 17 having convex forward edge 17*a*, while flexible lower edge 14 fits below or underlaps nail 17, i.e., natural nail 17 is inserted in wedge shaped pocket 15 as shown in FIG. 4. As shown in FIG. 1 lower edge 14 may have one or more slots 16 to assure flexibility of the nail extender, permitting it to adapt to the shape of the natural nail.

The body 11 may consist of an acetate type or other flexible plastic material, and for best results the body maximum thickness lies between about 0.005 and 0.025 inches.

The plastic material selected for the artificial nail tip should have properties as follows. The material must be readily injection moldable in the required thin cross sectional dimensions. It should be flame retardant and be easily cementable with a type of adhesive which at the time has good adherence to a natural nail, but it must not be unduly softened by the adhesive. In addition, the material must be able to be trimmed by means of scissors, files and sanding boards. It must further offer good adhesion for conventional nail polish lacquers.

The preferred material meeting all of the above specifications is a formulation of cellulose acetate such as Tenite 091092, Celludor U or equivalent.

For mounting the fingernail extension, it is desirable that space D, the entrance to pocket 15 be greater than the thickness T of natural nail 17, as shown in FIG. 5. It is likewise desirable that space E, the area near end 18 of pocket 15, be smaller in thickness than the thickness of natural nail 17 to assure tight wedging of artificial nail 11 onto natural nail 17. It will be noted that it is not necessary to trim natural nail 17 to conform exactly with pocket edge 18. This conformation is acacomplished by the decrease in the space inside the pocket.

In use, a small amount of quick drying liquid adhesive is applied in pocket 15 and the nail tip is positioned on the natural nail as shown in FIG. 3 and FIG. 4. Some of the liquid adhesive will be displaced by the natural nail and will flow by capillary action into all interstices of the interface of the nail tip with the natural nail, as indicated by numerals 19 and 16 of FIG. 5. A preferred quick drying adhesive is a formulation such as, for example: a blend of ethyl-isopropyl cyanoacrylate and polymethyl-methacrylate with hydroquinone as an inhibitor. A curing time of not less than 30 nor more than 60 seconds, with a viscosity of 1000–1500 centipoises is most desirable. Further, for safety reasons, the cured film of adhesive must be soluble in Acetone.

The "open" time of the preferred adhesive permits adjustment of the nail tip to assure proper match and alignment with the natural nail contour. The wedging action between pocket 15 and nail 17 maintains said alignment, permitting setting or hardening of the adhesive without the need for manual support of the tip during the drying time of the adhesive. Thus, self-application of nail tips is greatly facilitated.

Upon drying of the adhesive the artificial fingernail extension is firmly bonded to the natural nail. The surface of the live portion of the natural nail is not contacted by the liquid adhesive, or covered by the plastic nail extension, preserving the health of the live surface of the natural nail. Additionally, the upper surface of the artificial nail adjacent tapered edge 13 may be filed or buffed to form a smooth junction with natural nail 17.

It can be seen that the proposed structure adds mechanical strength by providing a "wedge splice", whose resistance to displacement in both directions (but particularly in the "lifting direction") is limited only by the strength of the nail components themselves, not considering any additional strength gained through the increased bonding area.

Although the invention has been described with reference to specific forms thereof, it will be understood that changes and modifications may be made within the spirit of the invention.

What is claimed is:

1. An artificial fingernail extension attachable to a natural fingernail comprising:

(a) A nail extension body having a forwardmost edge, and (b) a rearward concave distal upper edge and a rearward concave lower edge forming a wedge shaped arcuate pocket to receive and conform generally to the shape of the convex forward edge of the natural fingernail to position the artificial nail so that it will overlap and underlap the natural nail and be bonded thereto.

2. An artificial fingernail extension attachable to a natural fingernail comprising:

(a) A nail extension body having a forwardmost edge, and (b) a rearward concave distal upper edge and a rearward concave lower edge forming a wedge shaped arcuate pocket to receive and conform generally to the shape of the convex forward edge of the natural fingernail to position the artificial nail so that it will overlap and underlap the natural nail and be bonded thereto, wherein said rearward lower edge is sectioned to assure transverse conformance with the curvature of the natural nail.

3. The artificial nail extension of claim 2 wherein the rearward concave distal upper edge is tapered.

* * * * *